US007182004B1

(12) United States Patent
Wang

(10) Patent No.: US 7,182,004 B1
(45) Date of Patent: Feb. 27, 2007

(54) QUICK ADJUSTABLE DEVICE FOR PLIERS

(76) Inventor: Chien-Kuo Wang, 6F-6, No. 130, Sec. 2, Chung Hsiao E. Road, Taipei (TW)

( * ) Notice: Subject to any disclaimer, the term of this patent is extended or adjusted under 35 U.S.C. 154(b) by 0 days.

(21) Appl. No.: 11/208,713

(22) Filed: Aug. 23, 2005

(51) Int. Cl.
*B25B 7/04* (2006.01)
*B25B 7/10* (2006.01)

(52) U.S. Cl. ..... 81/409.5; 81/413; 81/411

(58) Field of Classification Search ..... 81/409.5, 81/407–409, 405, 411, 413, 391–393
See application file for complete search history.

(56) References Cited

U.S. PATENT DOCUMENTS 4,296,655 A * 10/1981 Tesoro ..... 81/405
4,581,960 A * 4/1986 Putsch et al. ..... 81/411
4,651,598 A * 3/1987 Warheit ..... 81/407
4,773,288 A * 9/1988 Jang et al. ..... 81/409.5
4,893,530 A * 1/1990 Warheit ..... 81/409.5
5,351,584 A * 10/1994 Warheit ..... 81/407
6,199,459 B1 * 3/2001 Azkona ..... 81/411
6,880,434 B2 * 4/2005 Nouvel ..... 81/409
2003/0140742 A1 * 7/2003 Nouvel ..... 81/409
2004/0194590 A1 * 10/2004 Engvall et al. ..... 81/413
2004/0194591 A1 * 10/2004 Engvall et al. ..... 81/413
2005/0262974 A1 * 12/2005 Engvall et al. ..... 81/413
2006/0027055 A1 * 2/2006 Schmitt et al. ..... 81/411

* cited by examiner

*Primary Examiner*—D. S. Meislin

(57) ABSTRACT

An adjustable device for pliers includes an operation member movably extending through a through hole in the first part and a slot in the second part. The operation member includes an exterior smooth section and a toothed section which can be disengageably engaged with teeth defined in the slot to set the width between the two jaws. A spring is biased to the operation member and stopped by an end member which is connected to a positioning member mounted to the operation member. The operation member is pushed to disengage the toothed section from the teeth of the slot so that the two parts can be pivoted to adjust the two jaws to a desired width and the operation member is released which is pushed back by the spring to engage the toothed section of the operation member with the teeth of the slot.

3 Claims, 5 Drawing Sheets

QUICK ADJUSTABLE DEVICE FOR PLIERS

FIELD OF THE INVENTION

The present invention relates to a quick adjustable device for a pliers and the device includes an operation member which is pushed to adjust the width between two jaws.

BACKGROUND OF THE INVENTION

A conventional adjustable pliers generally includes two handles pivotably connected with each other by a pivot and each handle includes a jaw so that a pipe or an object can be clamped between the two jaws. The pivot includes a rectangular cross section and extends through a hole in one of the two handles and a slot in the other handle, a distal end of the pivot is connected with a nut or a C-shaped clip to prevent the pivot from being pulled out from the hole and the slot. Although the width between the two jaws can be adjusted by pivoting either of the two handles at angle, the adjustment steps are not smooth and precise enough so that the user usually tries several times to set the desired width between the two jaws.

The present invention intends to provide an adjustable device for pliers and the user simply pushes an operation member to pivot either one of the two handles till a desired width is reached, the operation member is then released to automatically set the width of the pliers.

SUMMARY OF THE INVENTION

The present invention relates to an adjustable pliers that comprises a first part with a first jaw and the second part with a second jaw. The first and second parts are pivotably connected with each other by an adjustable device extending through a through hole in the first part and a slot of the second part. The slot includes teeth defined in an inner periphery thereof.

The adjustable device includes an operation member which includes an exterior smooth section and a toothed section which is disengageably engaged with the teeth of the slot. The operation member is pushed to disengage the toothed section from the teeth of the slot so that the user may adjust the width between the two jaws.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
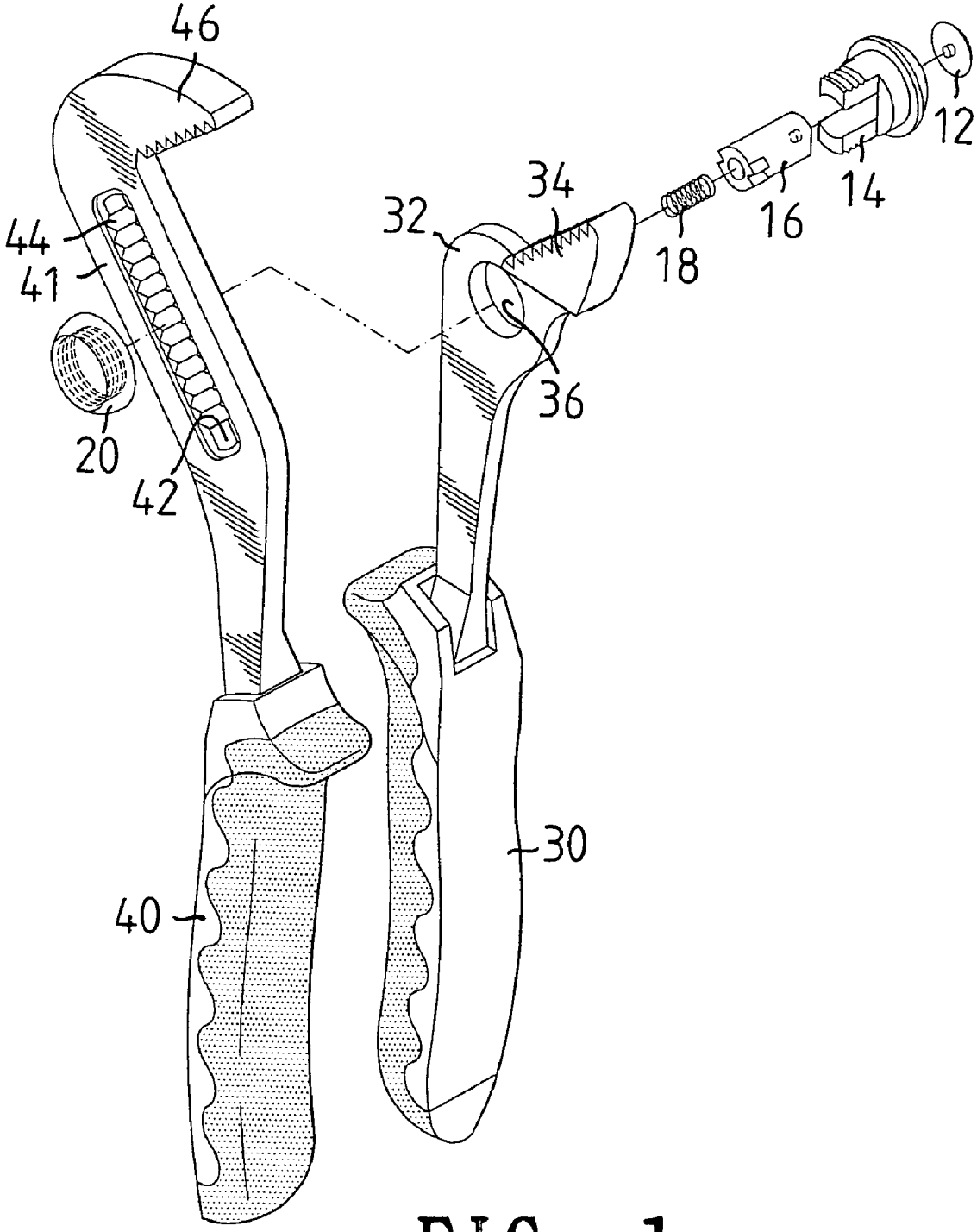
FIG. 1 is an exploded view to show the pliers and the adjustable device of the present invention.
Figure 2:
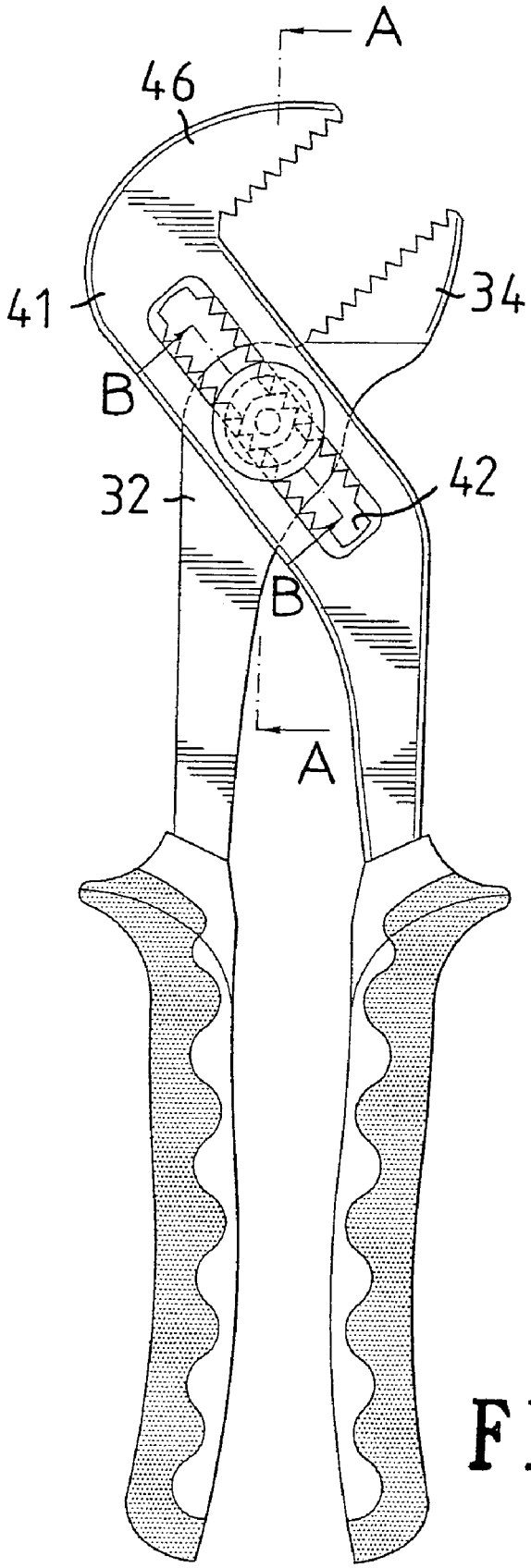
FIG. 2 is a side view to show the pliers with the adjustable device of the present invention.

Referring to FIGS. 1, 2, 4 and 5, the pliers of the present invention comprises a first part having a first grip portion 30 at a first end of the first part and a through hole 36 defined through a second end 32 of the first part. A first jaw 34 extends from the second end 32 of the first part. A second part has a second grip portion 40 at a first end of the second part and a slot 42 is defined through a second end 41 of the second part. A plurality of teeth 44 is defined in an inner periphery of the slot 42. A second jaw 46 extends from the second end 41 of the second part.

An adjustable device movably extends through the through hole 36 and the slot 42 and includes a cylindrical operation member 16 which includes a teardrop shaped cross section and an exterior smooth section and a toothed section 16 which is disengageably engaged with the teeth 44 of the slot 42.

Figure 3A:
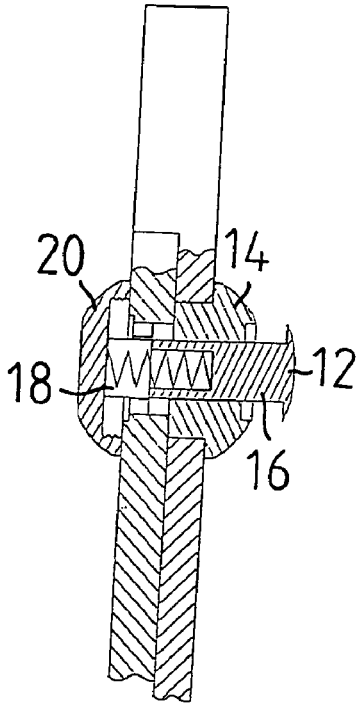
FIG. 3A is a cross sectional view along line A—A in FIG. 2 to show that the operation member of the adjustable device is not yet pushed.

Further referring to FIG. 3A, a positioning member 14 has a passage defined axially therethrough and the operation member 16 movably extends through the passage. The positioning member 14 extends through the through hole 36 and the slot 42 and includes two extensions and each extension has a threaded outer periphery which is threadedly fixed to an end member 20 with a close end. The operation member 16 includes a recess axially defined in a first end thereof and a spring 18 has a first end received in the recess. A second of the spring 18 is in contact with the close end of the end member 20. A second end of the operation member 16 extends through the passage of the positioning member 14 and is fixed to a button member 12 which is located outside of the positioning member 14.

Figure 3B:
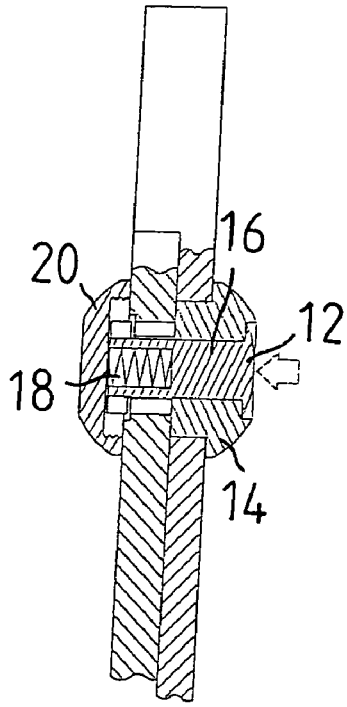
FIG. 3B is a cross sectional view along line B—B in FIG. 2 to show that the operation member of the adjustable device is pushed.
Figure 3C:
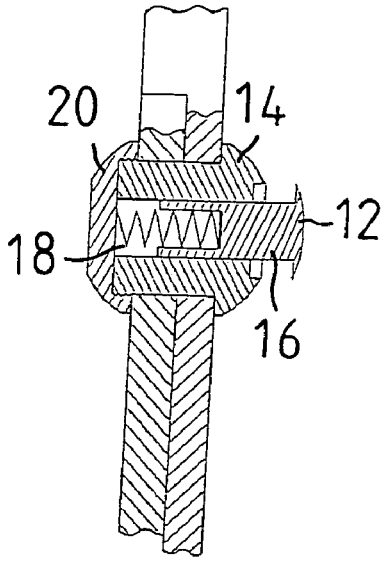
FIG. 3C shows that the operation member of the adjustable device is released.
Figure 4:
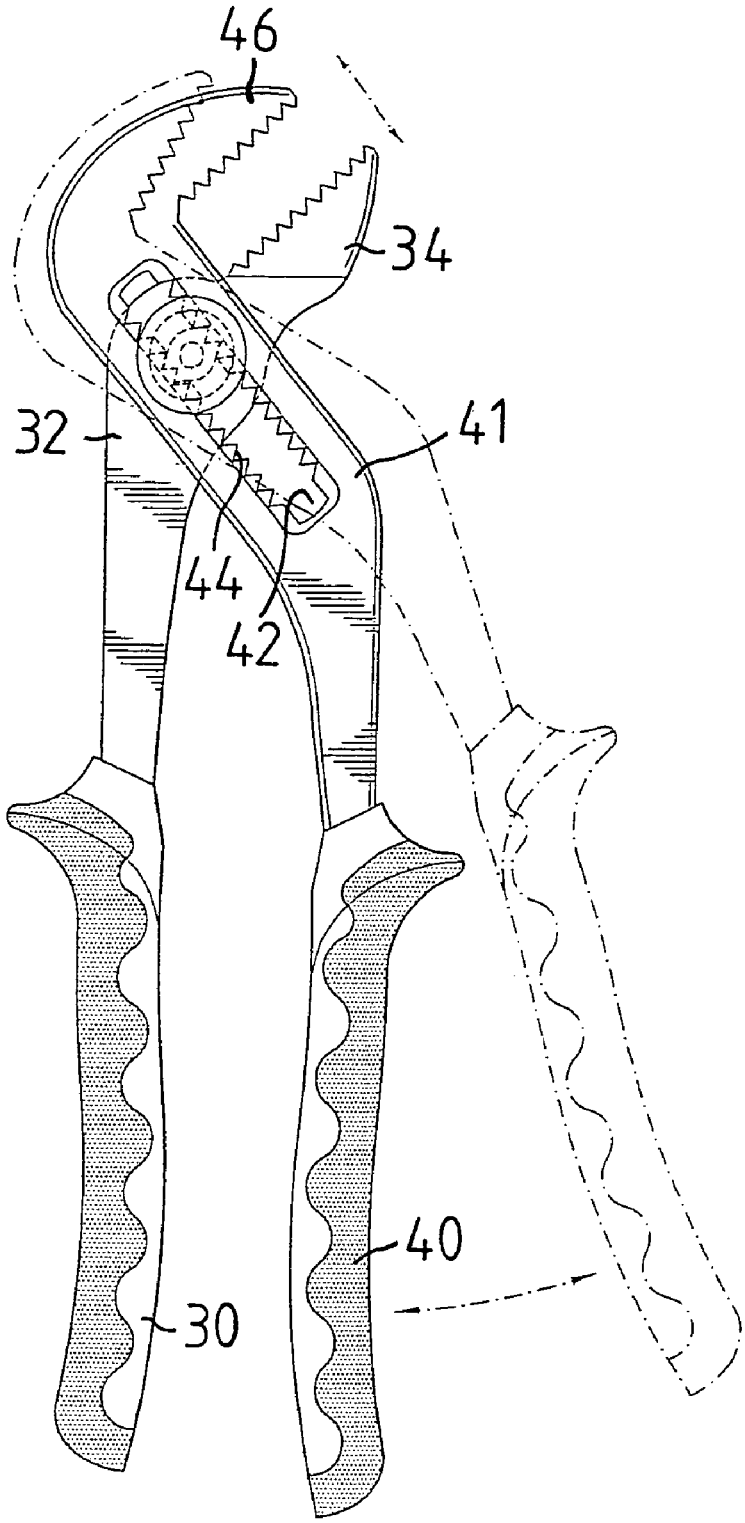
FIG. 4 shows that the second part is pivoted relative to the first part.
Figure 5:
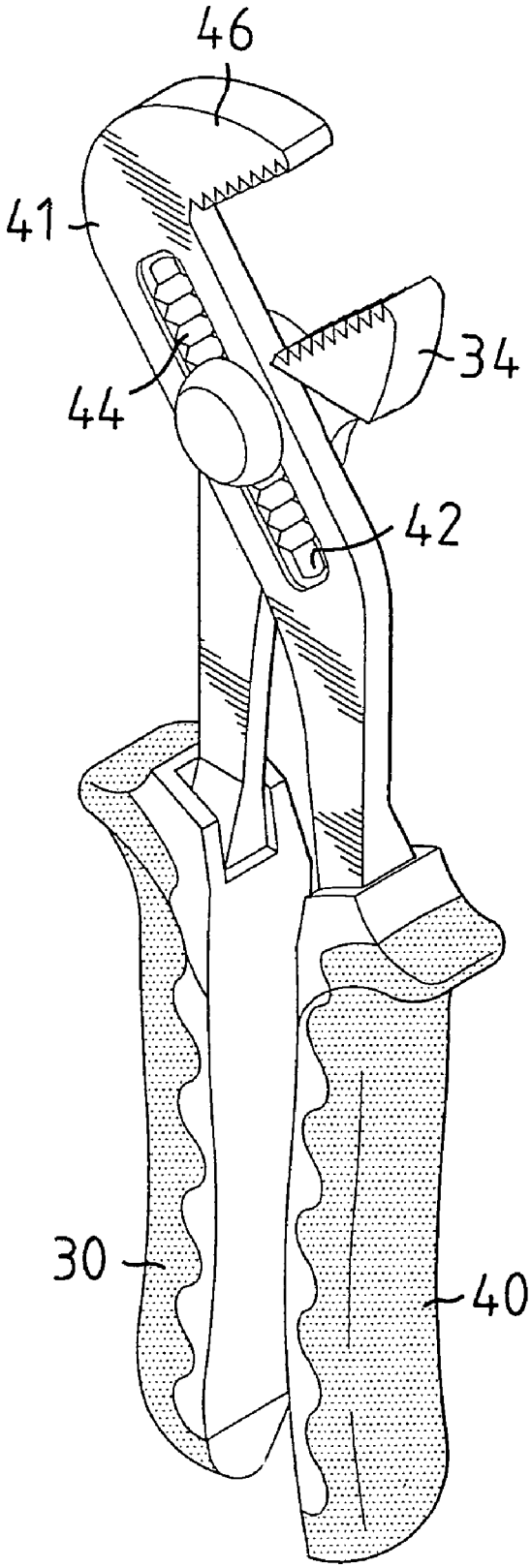
FIG. 5 is a perspective view to show the pliers with the adjustable device of the present invention.

As shown in FIGS. 3B and 3C, when adjusting the width between the two jaws 34, 46, the user simply pushes the button member 12 to shift the operation member 16 and compress the spring 18, the toothed section 16 is disengaged engaged from the teeth 44 of the slot 42 so that the first part and the second part can be moved relative to each other to adjust the width between the two jaws 34, 46. When a desired width between the two jaws 34, 46 is reached, the button member 12 is released and the operation member 16 is pushed by the spring 18 to let the toothed section 16 be engaged with the teeth 44 of the slot 42 again.

While we have shown and described the embodiment in accordance with the present invention, it should be clear to those skilled in the art that further embodiments may be made without departing from the scope of the present invention.

What is claimed is:

1. An adjustable pliers comprising:

a first part having a first grip portion at a first end of the first part and a through hole defined through a second end of the first part, a first jaw extending from the second end of the first part;

a second part having a second grip portion at a first end of the second part and a slot defined through a second end of the second part, a plurality of teeth defined in an inner periphery of the slot, a second jaw extending from the second end of the second part;

an adjustable device movably extending through the through hole and the slot and including an operation member which includes an exterior smooth section and a toothed section which is disengageably engaged with the teeth of the slot, and a positioning member having a passage defined axially therethrough and the operation member movably extending through the passage, the positioning member extending through the through hole and the slot and being fixed to an end member which has a closed end, the operation member including a recess axially defined in a first end thereof, a spring having a first end received in the recess and a second of the spring being in contact with the closed end of the end member.

2. The pliers as claimed in claim 1, wherein the operation member has a teardrop shaped cross section.

3. The pliers as claimed in claim 1, wherein a button member located outside of the positioning member is fixedly connected to the second end of the operation member.

* * * * *